US012201163B1

(12) United States Patent
Chavez

(10) Patent No.: US 12,201,163 B1
(45) Date of Patent: Jan. 21, 2025

(54) PANTYHOSE WITH GUSSETED WAISTBAND

(71) Applicant: Lenora A. Chavez, Denver, CO (US)

(72) Inventor: Lenora A. Chavez, Denver, CO (US)

(73) Assignee: Lenora A. Chavez, Denver, CO (US)

( * ) Notice: Subject to any disclaimer, the term of this patent is extended or adjusted under 35 U.S.C. 154(b) by 18 days.

(21) Appl. No.: 17/407,728

(22) Filed: Aug. 20, 2021

(51) Int. Cl.
*A41B 11/14* (2006.01)
*A41B 11/12* (2006.01)

(52) U.S. Cl.
CPC ..... *A41B 11/14* (2013.01); *A41B 11/123* (2013.01)

(58) Field of Classification Search
CPC .... A41C 1/02; A41C 1/08; A41B 9/00; A41B 9/001; A41B 9/04
See application file for complete search history.

(56) References Cited

U.S. PATENT DOCUMENTS 175,733 A * 4/1876 Myers et al. ..... A41F 9/02 D2/742
441,637 A * 12/1890 Bloch ..... A41F 9/02 2/237
541,334 A * 6/1895 Roschi ..... A41D 1/06 D2/742
2,826,760 A 3/1958 Rice
3,734,101 A * 5/1973 LoCascio ..... A41C 1/02 D2/702
3,757,354 A * 9/1973 Moody ..... A41B 11/14 2/409
3,987,650 A * 10/1976 Negri ..... D04B 1/106 66/177
4,021,861 A 5/1977 Imboden et al.
4,794,939 A 1/1989 Okuda
5,280,652 A * 1/1994 Davis ..... D04B 1/106 66/178 R
8,661,568 B1 3/2014 O'Brien
2004/0006811 A1* 1/2004 McKenzie ..... A41B 11/14 2/240
2008/0282450 A1* 11/2008 Suga ..... A61F 13/72 2/401
2010/0235970 A1* 9/2010 Rad ..... A41B 11/14 2/409
2014/0273741 A1* 9/2014 Hays ..... A41D 1/06 450/156
2015/0196066 A1* 7/2015 Emanuel ..... A41D 31/30 424/630

(Continued)

FOREIGN PATENT DOCUMENTS

EP 2486813 B1 * 4/2014 ..... A41B 11/14

OTHER PUBLICATIONS

Machine Translation for EP 2,486,813 B1, provided via Espacenet Patent Translate on Aug. 3, 2023 (Year: 2023).*

*Primary Examiner* — Jocelyn Bravo
(74) *Attorney, Agent, or Firm* — Patent Capital Group

(57) ABSTRACT

One general aspect includes a hosiery garment. The hosiery garment also includes knitted or woven stockings disposed to fully or partially cover a wearer's legs. The garment also includes a panty affixed to an upper end of the stockings and disposed to cover the wearer's thighs and hips. The garment also includes a waistband affixed to an upper end of the panty, the waistband having a height of at least two inches and having at least one strain-relief gusset, may include at least a front gusset and a rear gusset. Other embodiments of this aspect include similar garments.

17 Claims, 7 Drawing Sheets

(56) References Cited

U.S. PATENT DOCUMENTS

| | | | | |
|---|---|---|---|---|
| 2018/0368483 | A1 | 12/2018 | Hague et al. | |
| 2019/0320738 | A1* | 10/2019 | Kiuchi | A41D 1/215 |
| 2020/0281280 | A1* | 9/2020 | Suffolk | D04B 1/243 |

* cited by examiner

PANTYHOSE WITH GUSSETED WAISTBAND

TECHNICAL FIELD

This application relates in general to ladies' undergarments, and more particularly though not exclusively to pantyhose with a gusseted waistband.

BACKGROUND

Pantyhose are a type of ladies' undergarments. As the name implies, pantyhose may include hose or stockings that are integrally joined to a panty, to form a one-piece garment.

SUMMARY

One general aspect includes a hosiery garment. The hosiery garment also includes knitted or woven stockings disposed to fully or partially cover a wearer's legs. The garment also includes a panty affixed to an upper end of the stockings and disposed to cover the wearer's thighs and hips. The garment also includes a waistband affixed to an upper end of the panty, the waistband having a height of at least two inches and having at least one strain-relief gusset, may include at least a front gusset and a rear gusset. Other embodiments of this aspect include similar garments.

BRIEF DESCRIPTION OF THE DRAWINGS

The present disclosure is best understood from the following detailed description when read with the accompanying FIGURES. It is emphasized that, in accordance with the standard practice in the industry, various features are not necessarily drawn to scale, and are used for illustration purposes only. Where a scale is shown, explicitly or implicitly, it provides only one illustrative example. In other embodiments, the dimensions of the various features may be arbitrarily increased or reduced for clarity of discussion. Furthermore, the various block diagrams illustrated herein disclose only one illustrative arrangement of logical elements. Those elements may be rearranged in different configurations, and elements shown in one block may, in appropriate circumstances, be moved to a different block or configuration.

DETAILED DESCRIPTION

Figure 1:
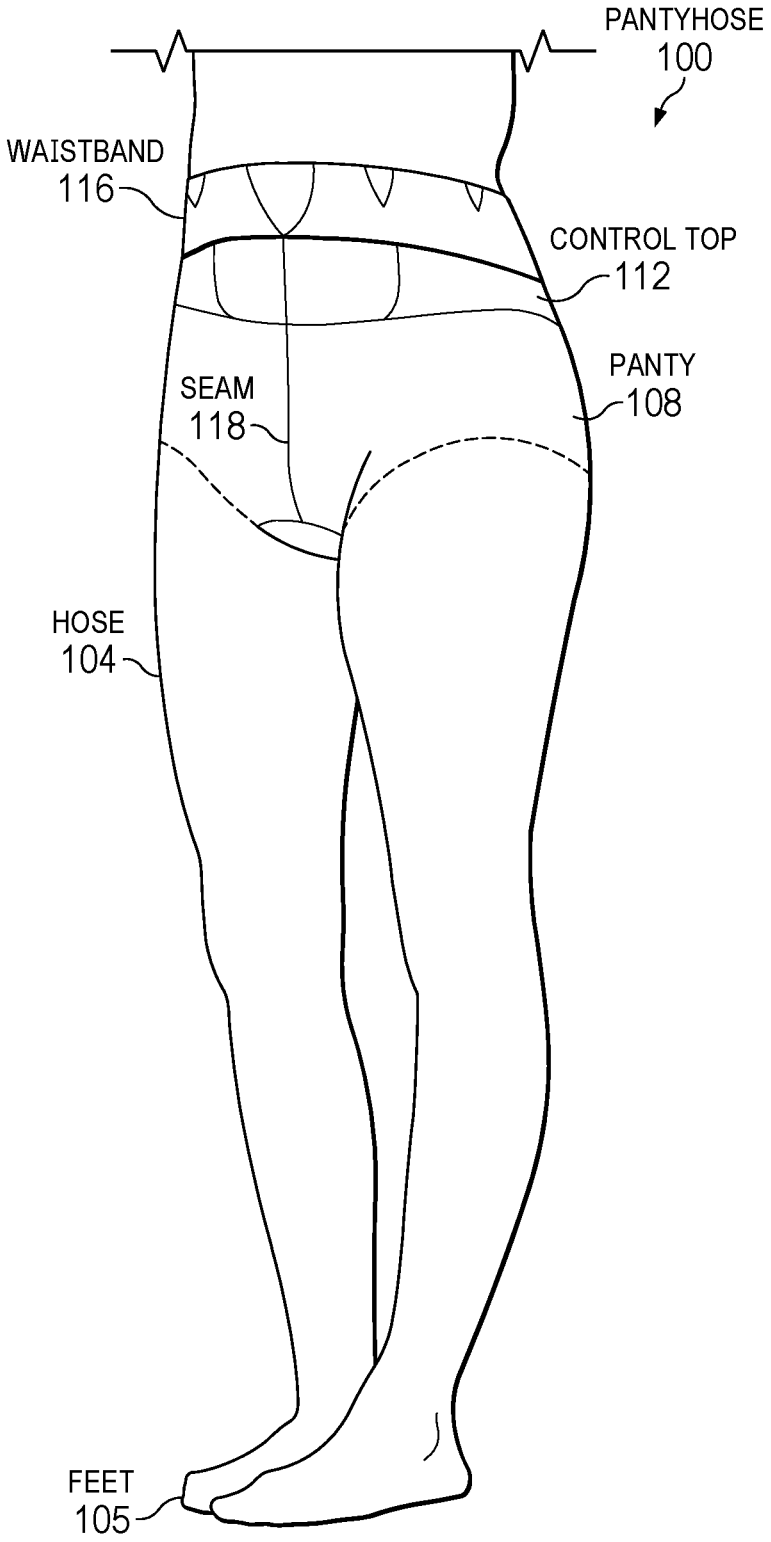
FIG. 1 is a perspective view of pantyhose with gusseted waistband.

The following disclosure provides many different embodiments, or examples, for implementing different features of the present disclosure. Specific examples of components and arrangements are described below to simplify the present disclosure. These are, of course, merely examples and are not intended to be limiting. Further, the present disclosure may repeat reference numerals and/or letters in the various examples. This repetition is for the purpose of simplicity and clarity and does not in itself dictate a relationship between the various embodiments and/or configurations discussed. Different embodiments may have different advantages, and no particular advantage is necessarily required of any embodiment.

A description of pantyhose, as in this specification, is complicated by inconsistent, variable, and/or regional usage for describing various forms of ladies' undergarments having integrated stockings or hose with a panty. Commonly, in American usage, the term "pantyhose" refers to sheer hosiery, and "tights" refers to a similar garment with higher denier, making them opaque or semi-opaque. In British usage, the term "tights" refers to pantyhose garments, regardless of denier.

Throughout this specification, the term "pantyhose" refers to any garment having an integrated panty with hose or stockings, with or without feet, and regardless of denier. Furthermore, although pantyhose are generally considered ladies' undergarments, men may also less commonly wear pantyhose for various purposes, such as for warmth, to increase circulation, as a base layer, or as part of a cross-dressing regimen. Ladies' pantyhose are used throughout this specification to illustrate the principles disclosed herein, but the teachings should be understood to apply to pantyhose garments in general, whether designed for (or worn by) men or women.

Women may wear pantyhose to achieve various advantages. For example, they may smooth the legs, conceal blemishes, conceal leg hair, increase circulation, provide shaping or control, provide warmth, provide a base layer, help prevent blisters from shoes, or provide a more professional or formal look as compared to bare legs. Many women also find pantyhose more comfortable and convenient than a traditional stockings-and-girdle combination, more common in the mid-20th Century. Indeed, the invention of pantyhose (as described in U.S. Pat. No. 2,826,760) was originally motivated by a pregnant woman who found her stockings and girdle prohibitively uncomfortable for day wear while pregnant, and they were originally hailed as a revolutionary product that freed women from the discomfort of girdles.

In some cases, pantyhose may also be a medical garment, with high-elasticity variations used to promote circulation, reduce leg and ankle swelling, and help prevent blood clots.

Despite these advantages, the most commonly observed complaint against pantyhose is that they are uncomfortable to wear. This has contributed to an overall downward trend in their use and popularity over approximately the last half century, although recent trends indicate a slight resurgence. Despite these trends, some women prefer the conservative appearance of covered legs, particularly for special occasions, social functions, or in religious settings (e.g., "Sunday best" dress). Some professional settings (such as airlines, banks, and law firms for example) may also require pantyhose as part of a dress code. Thus, it is advantageous to provide pantyhose that achieve the benefits listed, and that are more comfortable than those currently available.

One of the common comfort-based complaints against pantyhose is that they pinch and/or bind at the waist, or create a "muffin top" appearance. Thus, embodiments of the present specification provide an enhanced waistband with one or more strain-relief gussets that make wearing pantyhose more comfortable, without compromising the appearance of the hose, and without compromising their other benefits. Embodiments may also provide a control-top (or mixed sheer/control-top) panty, with control inserts, such as at the front and back, to help provide a smoothing appearance. Some embodiments may also include a wide waistband, with a width of between 2 to 6 inches, for example. This waistband may include strain relief gussets, and the un-gusseted portions of the waistband may optionally have an unfinished or raw upper edge, which may further increase comfort. In an embodiment, a plurality of gussets, such as eight gussets, may be provided. In other embodiments, as few as one gusset may be provided, such as at the front or rear, or two gussets, such as at the hips.

The foregoing can be used to build or embody several example implementations, according to the teachings of the present specification. Some example implementations are included here as non-limiting illustrations of these teachings.

Various garments may be constructed according to the teachings of the present specification. One general aspect includes a hosiery garment. The hosiery garment also includes knitted or woven stockings disposed to fully or partially cover a wearer's legs. The garment also includes a panty affixed to an upper end of the stockings and disposed to cover the wearer's thighs and hips. The garment also includes a waistband affixed to an upper end of the panty, the waistband having a height of at least two inches and having at least one strain-relief gusset, may include at least a front gusset and a rear gusset. Other embodiments of this aspect include similar garments.

Implementations may include one or more of the following features. The hosiery garment where the waistband has a height between approximately two inches and six inches. The waistband is constructed of a blend of approximately 72% nylon and approximately 28% elastane. The garment may include sheer or semi-sheer footed pantyhose. The garment may include opaque or semi-opaque footed tights. The garment may include convertible dance tights. The garment may include unfooted girls' or women's leggings. The garment may include short-legged shape wear. The garment is a girls', women's, men's, or gender-neutral sport pant. The waistband is disposed to extend from approximately the wearer's hips to approximately the wearer's bust. The gusset has a substantially triangular form factor. The hosiery garment may include left and right hip gussets. The hosiery garment may include front and rear gussets. The hosiery garment may include at least eight gussets spaced substantially equidistantly around a perimeter of the waistband. The panty has a denier value substantially equal to a denier value of the legs. The panty has a control top feature. The control top feature is constructed of a nylon-elastane blend, with an elastane content of at least approximately 15%. The panty is partially sheer with a control top feature. The panty may include a control top feature and a front control panel. The abdomen control panel may include antimicrobial treatment. The antimicrobial treatment may include metallic fibers. The hosiery garment may include a buttocks control panel. The gussets are constructed of a material different from the waistband. The gussets are constructed of substantially 100% nylon. Note that while certain embodiments are shown herein with the gusseted waistband in connection with tummy and buttocks control panels, embodiments are also anticipated with only the gusseted waistband, only a tummy control panel, only a buttocks control panel, or any combination of the three.

One general aspect includes ladies' pantyhose. The ladies' pantyhose also includes right and left stockings of knitted or woven fibers, the right and left stockings together terminating in a panty, the panty may include a tummy control panel and a buttocks control panel. The pantyhose also includes a waistband sewn to an upper end of the panty and having disposed therein at least one strain relief gusset.

Implementations may include one or more of the following features. The ladies' pantyhose may include a plurality of gussets disposed around a periphery of the waistband. The gussets are disposed substantially equidistantly around the periphery of the waistband. The waistband is constructed of a blend of approximately 72% nylon and approximately 28% elastane. The pantyhose are sheer or semi-sheer footed pantyhose. The pantyhose are opaque or semi-opaque footed tights. The pantyhose are convertible dance tights. The pantyhose are unfooted leggings. The pantyhose are short-legged shape wear. The waistband has a height between approximately two inches and six inches. The waistband is disposed to extend from approximately a wearer's hips to approximately a wearer's bust. The gusset has a substantially triangular form factor. The ladies' pantyhose may include left and right hip gussets. The ladies' pantyhose may include front and rear gussets. The ladies' pantyhose may include at least eight gussets spaced substantially equidistantly around a perimeter of the waistband. The panty has a denier value substantially equal to a denier value of the stockings. The panty has a control top feature. The control top feature is constructed of a nylon-elastane blend, with an elastane content of at least approximately 15%. The panty is partially sheer with a control top feature. The panty may include a control top feature and a front control panel. The abdomen control panel may include antimicrobial treatment. The antimicrobial treatment may include metallic fibers. The ladies' pantyhose may include a buttocks control panel. The gusset is constructed of a material different from the waistband. The gusset is constructed of 100% nylon.

One general aspect includes a method of manufacturing a ladies' hosiery garment. The method of manufacturing also includes knitting first and second stockings. The manufacturing also includes processing the first and second stockings to a desired color and shape. The manufacturing also includes joining an upper end of the first and second stockings together to form a panty. The manufacturing also includes affixing a waistband having a width of between two inches and eight inches onto an upper end of the panty. The manufacturing also includes cutting a plurality of gusset apertures into the waistband. The manufacturing also includes sewing gussets into the gusset apertures, where the gussets are of a different material from the waistband. Another aspect includes any garment manufactured according to this method.

Implementations may include one or more of the following features. The method may include affixing front and rear control panels to the panty. Joining the first and second stockings may include slicing a slit at respective welts of the first and second stockings, and sewing the slits together. The gussets have a substantially triangular form factor. The gussets may include front and rear gussets. The gussets may include left and right hip gussets. The plurality of gussets may include at least eight gussets spaced substantially equidistantly around a perimeter of the waistband. The panty has a denier value substantially equal to a denier value of the stockings. The panty has a control top feature. The control top feature is constructed of a nylon-elastane blend, with an elastane content of at least approximately 15%. The panty is partially sheer with a control top feature. The panty is a control top panty, and may include adding an abdomen control panel to the control top panty. The method may include adding an antimicrobial treatment to the abdomen control panel. The antimicrobial treatment may include metallic fibers. The method may include adding a buttocks control panel to the control top panty. The gussets are constructed of a material different from the waistband.

Embodiments of pantyhose with a gusseted waistband, including a method of manufacturing, will now be described with more particular reference to the attached FIGURES. It should be noted that throughout the FIGURES, certain reference numerals may be repeated to indicate that a particular device or block is referenced multiple times across several FIGURES. In other cases, similar elements may be given new numbers in different FIGURES. Neither of these practices is intended to require a particular relationship between the various embodiments disclosed. In certain examples, a genus or class of elements may be referred to by a reference numeral ("widget 10"), while individual species or examples of the element may be referred to by a hyphenated numeral ("first specific widget 10-1" and "second specific widget 10-2").

FIG. 1 is a perspective view of a pantyhose garment 100. Pantyhose garment 100 includes a panty 108, a waistband 116, hose 104 (which also may be referred to as stockings 104), and feet 105. In this illustrative embodiment, pantyhose 100 are shown as footed pantyhose, meaning that the pantyhose fully cover the wearer's feet. Other embodiments may partially cover the wearer's feet (as in toeless pantyhose), or be convertible as in the case of convertible dance tights, which may be shifted to cover the feet or not.

Pantyhose 100 may be constructed of various materials, such as nylon, elastane (also called Spandex or Lycra), rayon, microfiber, or combinations thereof. In this embodiment, pantyhose 100 provide an optional control top feature 112, which may be a high-elasticity feature that helps to smooth and control the hips and abdomen. In some embodiments, panty 108 may be reinforced, and portions of feet 105 may also be reinforced, such as the toes and/or heel. In yet other embodiments, a reinforced heel may also transition into a full back seam. Such back seams are originally a product of manufacturing processes that required stitching flat hosiery into a tubular form. While such manufacturing methods are now rare, back seams may nevertheless be added for fashion purposes.

In yet other embodiments, pantyhose 100 may be medical compression stockings, with high elasticity. Compression ratings are measured in pressure in units of millimeters of mercury (mmHg), and the compression rating may be, for example, 15-20 mmHg, 20-30 mmHg, 30-40 mmHg, 40-50 mmHg. In the case of medical compression stockings, the high-compression component may taper off toward the upper portion of hose 104 and become more sheer.

When wearing a skirt or pants, generally at least a portion of hose 104 are intended to be externally visible. Thus, a consumer may select pantyhose 100, at least in part, based on the appearance of hose 104, including the weight (sheerness) and color. In some cases, hose 104 may also include decorative prints or patterns. The weight (measured in denier) may also affect the thermal properties of pantyhose 100; for example, a consumer may select lower-denier pantyhose for warm weather wear, and higher-denier pantyhose for cold weather wear. There are not any known definite industry standards regarding denier ranges. Approximately 5 denier is generally the lowest weight commercially available, and may require a reinforce panty 108 and feet 105 to have reasonable durability. High-denier "blackout" tights may have a denier value of 100 or more. Women's leggings or stretch pants may also be considered a species of pantyhose garment, and may have a high enough thread weight that they are generally not measured in denier. In general, pantyhose 100 may have hose 104 in any of the following denier ranges. Notably, the denier ranges may overlap, and distinctions are not well-defined in the industry.

| Nominal Range | Denier |
|---|---|
| Ultra Sheer | 5-10 |
| Sheer | 10-20 |
| Semi-Sheer | 20-40 |
| Semi-Opaque | 30-50 |
| Opaque | Over 50 |
| Blackout | Over 100 |

Hose 104 may be constructed of single or blended fabric. For example, hose 104 may be 100% nylon, or may be constructed of a first or primary material at approximately 65%-90%, and a secondary material of approximately 10%-35%. The primary material is commonly nylon, and the secondary material may provide additional properties such as sheen or stretch. The secondary material may be, for example, elastic, Spandex, Rayon, Lycra, Elastene, or others. In other embodiments, multiple fabrics may be blended, such as three or more fabrics. In another embodiment, natural silk fibers may be used, such as 100% natural silk, or a blend of 96% natural silk with 4% Lycra, or 65%-96% natural silk, with 4%-35% of a secondary material. In yet another embodiment, a high-durability ballistic fiber, such as ultra-high molecular weight polyethylene (UHMWPE) may be used, as described in U.S. Patent Publication 2018/0368483, which is known in the art and is incorporated herein by reference. Any of the above listed blends may also be used with such a high-durability fiber.

Panty 108 may be a sheer panty, such as one made of the same fabric blend or substantially the same fabric blend as hose 104. In some cases, even if panty 108 is made of the same fabric blend, it may be reinforced, so that the thread weight and denier are higher than hose 104. For example, during manufacturing, feet 105 and hose 104 are generally knitted first, using a knitting machine with a very fine needle, such as a 400-gauge needle. To form reinforced portions of pantyhose 100, more needles may be used in the knitting process, thus providing more threads in the reinforced portions. Alternately, sheerer portions may be knitted using fewer needles, thus injecting fewer threads.

Control top 112 is illustrated here as a partial control top, as an illustrative and non-limiting example. In some cases, panty 108 is a full control top panty. To form control top 112, a different fabric blend or weight may be used, and in particular, control top 112 may be provided with additional elasticity (such as by having a higher proportion of spandex to nylon). Control top 112 may constitute only an upper portion of panty 108, or may include the full extent of panty 108. Options for constructing panty 108 may include sheer-to-waist, partially sheer, reinforced, partial-control top, full control top, or body shaper, by way of illustrative and nonlimiting example. In some cases, there is no definite boundary between hose 104 and panty 108, while in other cases a definite boundary can be seen where a reinforced or control top portion begins. This boundary, if it exists, may be anywhere between the upper thigh and the leg joint. Panty 108 generally extends to approximately the wearer's waist, and may terminate in waistband 116, which may be narrow or wide.

In common manufacturing techniques, two stockings 104 are knitted separately, each slitted on an adjoining side, and sewn together at a seam 118. However, seamless construction techniques are also known, such as by knitting hose 104 and panty 108 in a single or unitary process.

Waistband 116 is affixed to the top of panty 108. For example, waistband 116 may be manufactured separately, and sewn to the top of panty 108. Waistband 116 is shown here as a wide waist band, which can enhance the wearer's comfort. However, smaller waistbands are also known, and may be as small as a fraction of an inch thick. Furthermore, in some cases, waistband 116 is knitted in a singular process, along with stockings 104 and panty 108. While it is common for waistband to terminate at approximately the wearer's hips or abdomen, waistband 116 may also (such as in cases of "body-shaping" pantyhose) extend as high as the wearer's bust.

The material for waistband may be selected to provide sufficient stretch to secure pantyhose 100 to the wearer's hips and prevent sagging, while also maintaining comfort. For example, waistband 116 may comprise a blend of substantially 72% nylon/28% spandex. For comfort, waistband 116 may have a width of at least approximately 2 inches. Furthermore, waistband 116 may be non-symmetrical, or have a non-uniform width. For example, waistband 116 may be wider at the rear, which helps to prevent rear sagging of pantyhose 100. In one illustrative embodiment, waistband 116 transitions from a front width of approximately 4.5 inches to a rear width of approximately 5.5 inches. Further, as described in U.S. Pat. No. 8,661,568, which is incorporated herein by reference, waistband 116 may have at least a partially "raw" or "unfinished" upper edge to enhance the wearer's comfort.

In various embodiments, pantyhose 100 may have additional features, including those not shown in this particular embodiment, and certain features may be mixed and matched. Thus, FIG. 1 should be understood to illustrate an overall view of pantyhose 100, without limiting it to a particular set of features. Additional features of pantyhose 100 are described throughout this specification.

Figure 2A:
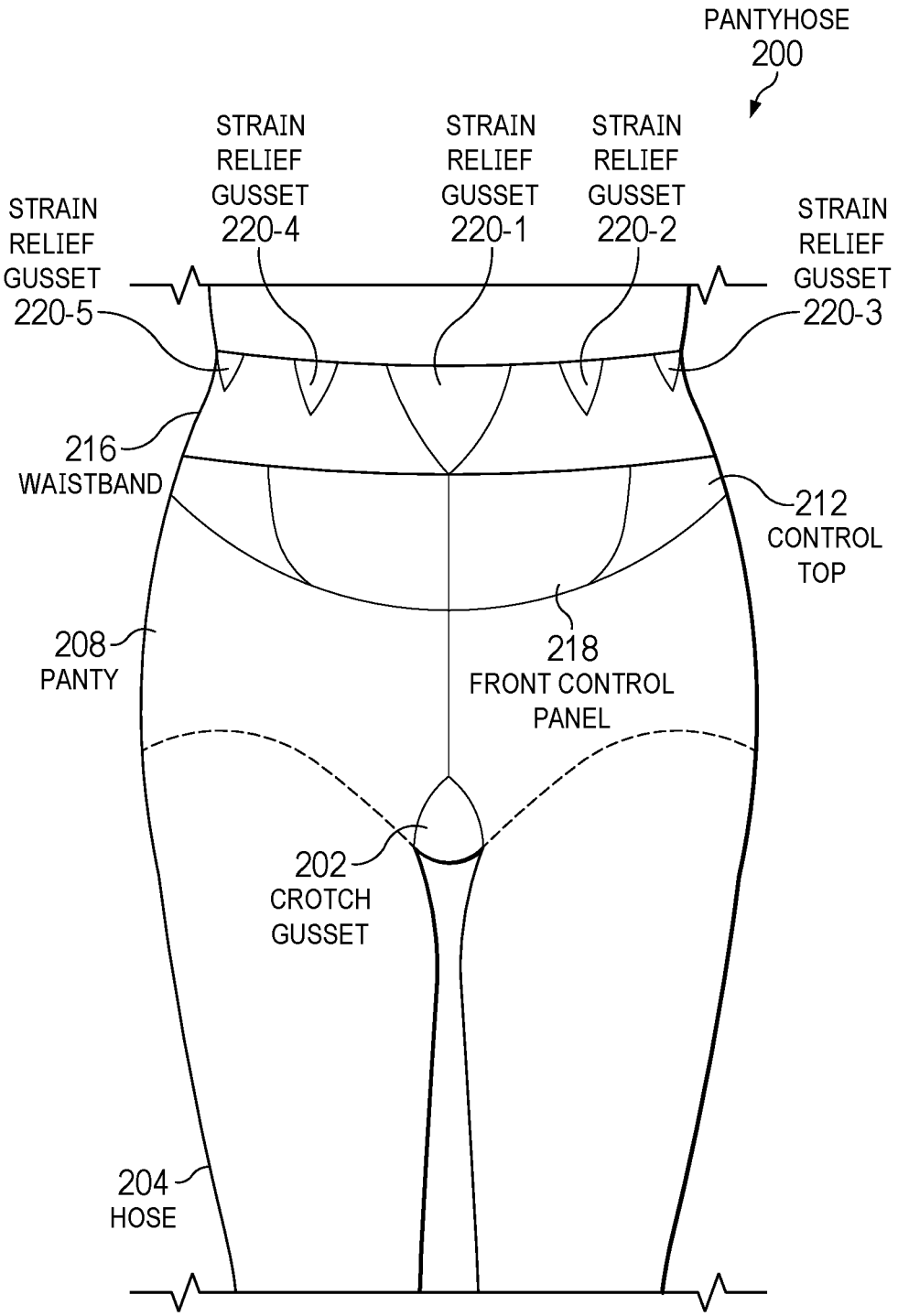
FIGS. 2A and 2B are front and rear views illustrating additional aspects of pantyhose with gusseted waistband.

FIG. 2A is a front view of pantyhose 200 illustrating additional features. Visible in FIG. 2A are hose 204, panty 208, control top 212, and waistband 216. For user comfort, and to provide sanitary features, a crotch gusset 202 may be sewn into a crotch between stockings 204. In some embodiments, crotch gusset 202 may be made of a reinforcing material, such as a reinforced version of the fabric used for hose 204, or it could be made of cotton or some other soft material, and may optionally have antimicrobial features. For example, an antimicrobial treatment may be applied to the front and/or rear panels, and could include the use of metallic fibers, which have natural antimicrobial properties. In this illustration, control top 212 is located only at the top of panty 208, and the rest of panty 208 may be reinforced, or may be sheer and of similar appearance to hose 204.

Control top 212 has a front (abdomen) control panel 218, which may be an insert with additional elasticity and control features. In one embodiment, front control panel 218 may have a high elasticity to help control and smooth the wearer's abdomen, and may also have metallic fibers such as silver, copper, or gold, which provide antimicrobial features. In an illustrative embodiment, control panel 218 may be made of, for example, 67% nylon, and 33% elastane.

In an embodiment, front control panel 218 may have a height (measured along the seam) of approximately 3.5 inches, which may optionally taper at the edges to approximately 2 inches. In an embodiment, control top 212 may have a center height (measured at the seam, or at the center of control panel 218) of approximately 3.5 inches, which may taper to approximately one inch at the hips.

Waistband 216 may be sewn to the top of control top 212, and for user comfort may have a width of between 2 and 6 inches. In another embodiment, waistband 216 may have a width selected to extend substantially to a wearer's bust. Optionally, waistband 216 may have an asymmetrical or nonuniform width. For example, waistband 216 could be wider at the back, which helps to prevent rolling, and to enhance comfort. Other configurations are also possible.

In this embodiment, certain triangular or semi-triangular regions of waistband 216 are cut out and are provided with strain relief gussets 220. In this illustration, five strain relief gussets 220 are visible, namely strain release gussets 220-1, 220-2, 220-3, 220-4, and 220-5. These are disposed so that one strain relief gusset 220-1 is directly at the front of the wearer's abdomen, while two gussets 220-3 and 220-5 are approximately at the wearer's hips. Intermediate gussets 220-2 and 220-4 are disposed between these two.

In an embodiment, gussets 220 may be of uniform size. In another embodiment, gussets 220 may be of non-uniform size, including graduated sizes. For example, gusset 220-1 may have a triangle base of at least approximately 1.5 inches, and a triangle height of at least approximately 3.25 inches, or alternatively, a triangle height that substantially matches the width of waistband 216. Gussets 220-2 and 220-4 may have a triangle base of at least approximately 0.75 inches, and a triangle height of at least approximately 1.5 inches. Gussets 220-3 and 220-5 may have a triangle base of at least approximately 0.5 inches, and a triangle height of at least approximately 1.0 inches. In some embodiments, the ratio of triangle height to triangle base may be approximately 2:1, or other ratios may be used such as 1:1, 1.5:1, or others.

Figure 2B:
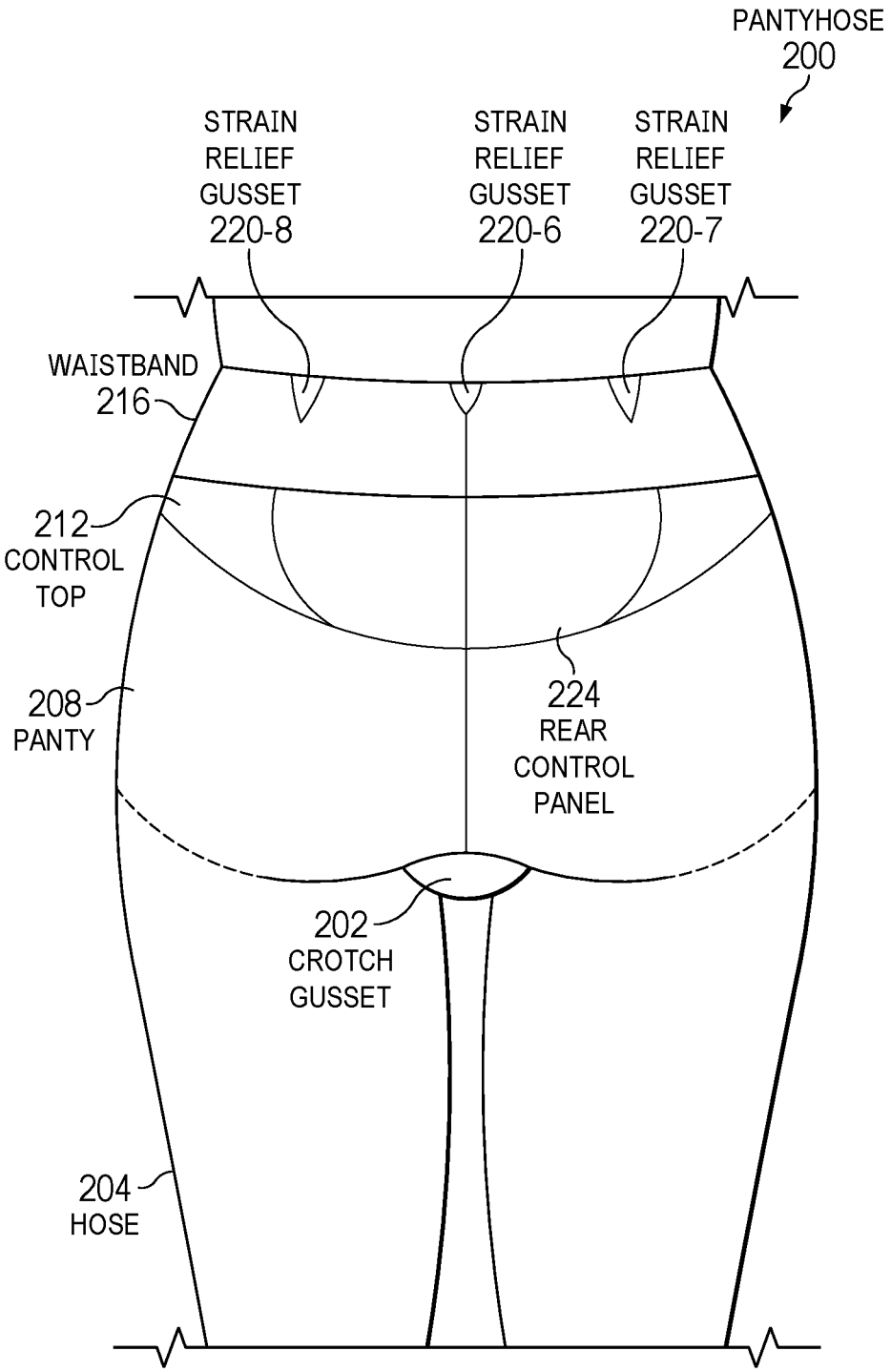

Turning to FIG. 2B, additional strain relief gussets 220-6, 220-7, and 220-8 are also shown. In addition to control panel 218 of FIG. 2A, a rear (buttocks) control panel 224 is also shown in this view. Rear control panel 224 may be provided to help control and smooth the wearer's buttocks, and may have a high elasticity. In an embodiment, rear control panel 224 is made of a similar material to front control panel 218, such as 67% nylon and 33% elastane, and may also have metallic threading.

Strain relief gussets 220 need not all have a uniform size. For example, to help avoid pinching and binding, strain relief gusset 220-1 at the front of the pantyhose may be larger than the other strain relief gussets. This provides additional strain relief at the front, while avoiding complications that may be encountered if all of the gussets are too large.

Strain relief gussets 220 may be manufactured separately, and may be of a material different from the material of waistband 216. Strain relief gussets 220 may generally have a softer and less stiff or elastic aspect than waistband 216. Thus, waistband 216 can provide sufficient elasticity to secure pantyhose 200 to the wearer, while strain relief gussets 220 can help to prevent pinching and binding, and to enhance the comfort of pantyhose 200. In an example, strain relief gussets 220 may be manufactured of rayon, microfiber, or 100% nylon.

In an illustrative embodiment, strain relief gussets 220 may be substantially triangular in shape. The base of the triangle may be disposed at the upper edge of waistband 216, and may be on the order of 1 to 4 inches. As discussed above, the triangles need not be of uniform size, shape, or construction. Furthermore, triangular strain relief gussets are not the only possible shape. Other embodiments are possible, such as rectangular or oval strain relief gussets.

Figure 3:
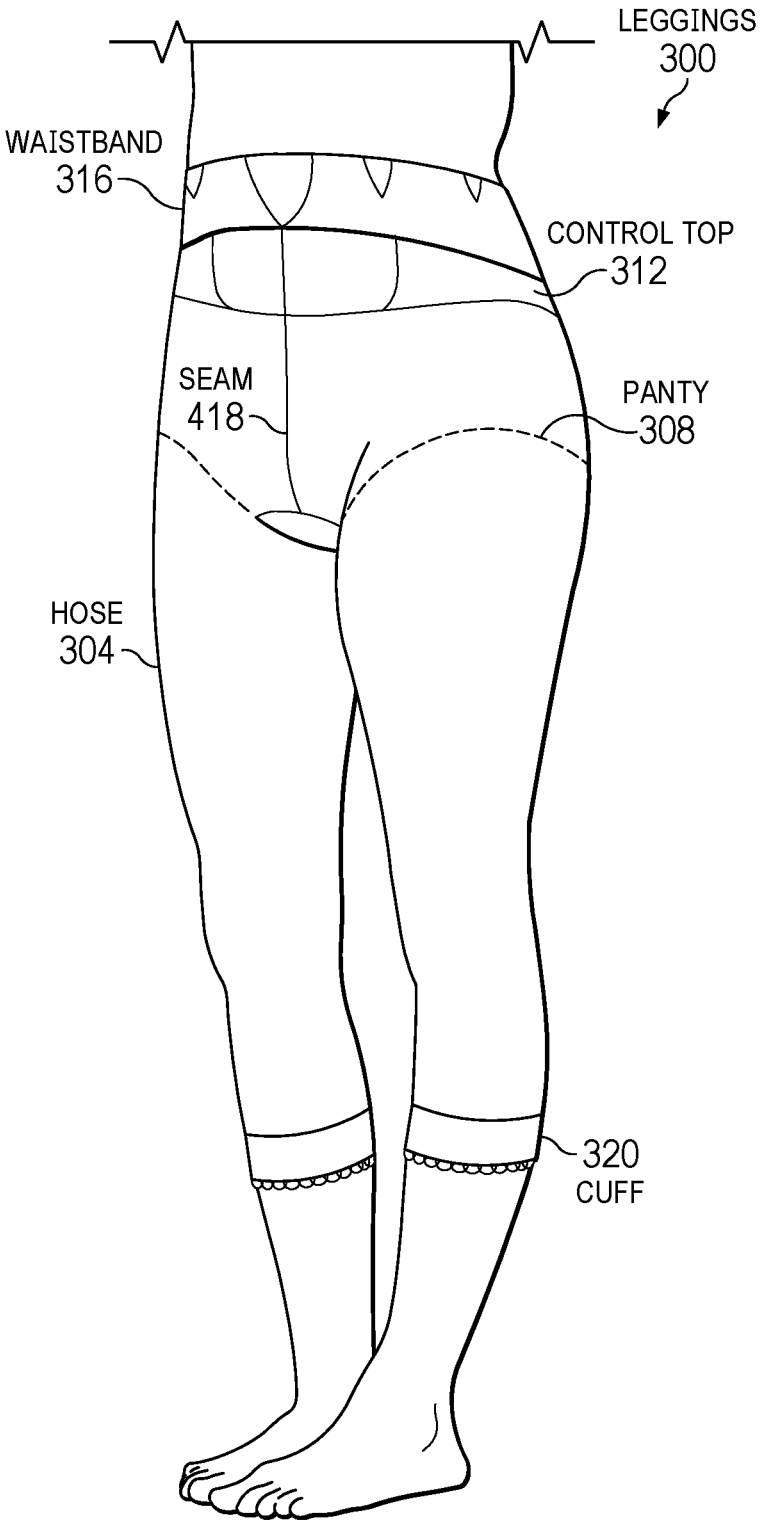
FIG. 3 is a perspective view of footless leggings having a gusseted waistband.

FIG. 3 shows an alternative embodiment of pantyhose, shown herein as leggings 300. As with pantyhose, 100 and 200, leggings 300 include hose or stockings 304, a panty 308, a control top 312, and a waistband 316, and seam 318. Unlike pantyhose 100 of FIG. 1, leggings 300 are unfooted, and may instead terminate at a cuff 320. Cuff 320 may be a plain cuff, such as terminating at a seam, or may be embellished with decorative elements such as lace or scalloping.

Leggings 300 may generally be perceived as less formal than pantyhose 100, and may be preferred for casual wear. Leggings 300 may provide warmth, and may be used to shape and/or smooth the wearer's legs. Leggings 300 may include features of pantyhose, 200, including front and rear panels, strain relief gussets, and other features, such as a reinforced, non-reinforced, sheer, control top, or other species of panty. As with pantyhose 100, leggings 300 could be sheer, semi-sheer, semi-opaque, or opaque, depending on user preferences.

Leggings 300 come in many different varieties, including varieties that are essentially unfooted pantyhose or tights, and which may be worn as a more casual alternative to traditional pantyhose under a skirt or dress. In other embodiments, leggings 300 are of a higher elasticity and sturdy fabric, and may be worn as close-fitting pants. In such embodiments, it is common to omit a crotch gusset 302, although other features such as strain relief gussets may be provided.

Thus, the basic structure of leggings 300 may be adapted to other uses such as stretch pants or a sport pant, which may be girls', women's, men's, or gender-neutral stretch pants. Such stretch pants are, in common usage, sometimes also referred to as "leggings" (particularly when they are designed for women), although other terms may also be used. In some of these cases, the term "panty" is not commonly used for the part that covers a wearer's thigh, hips, and abdomen. The term "panty" should be understood throughout this specification and the appended claims to represent the structural portion that covers the hips, thighs, and abdomen, whether for men's or ladies' garments, whether for undergarments or outerwear, and whether sheer, control top, opaque, or other construction.

Figure 4:
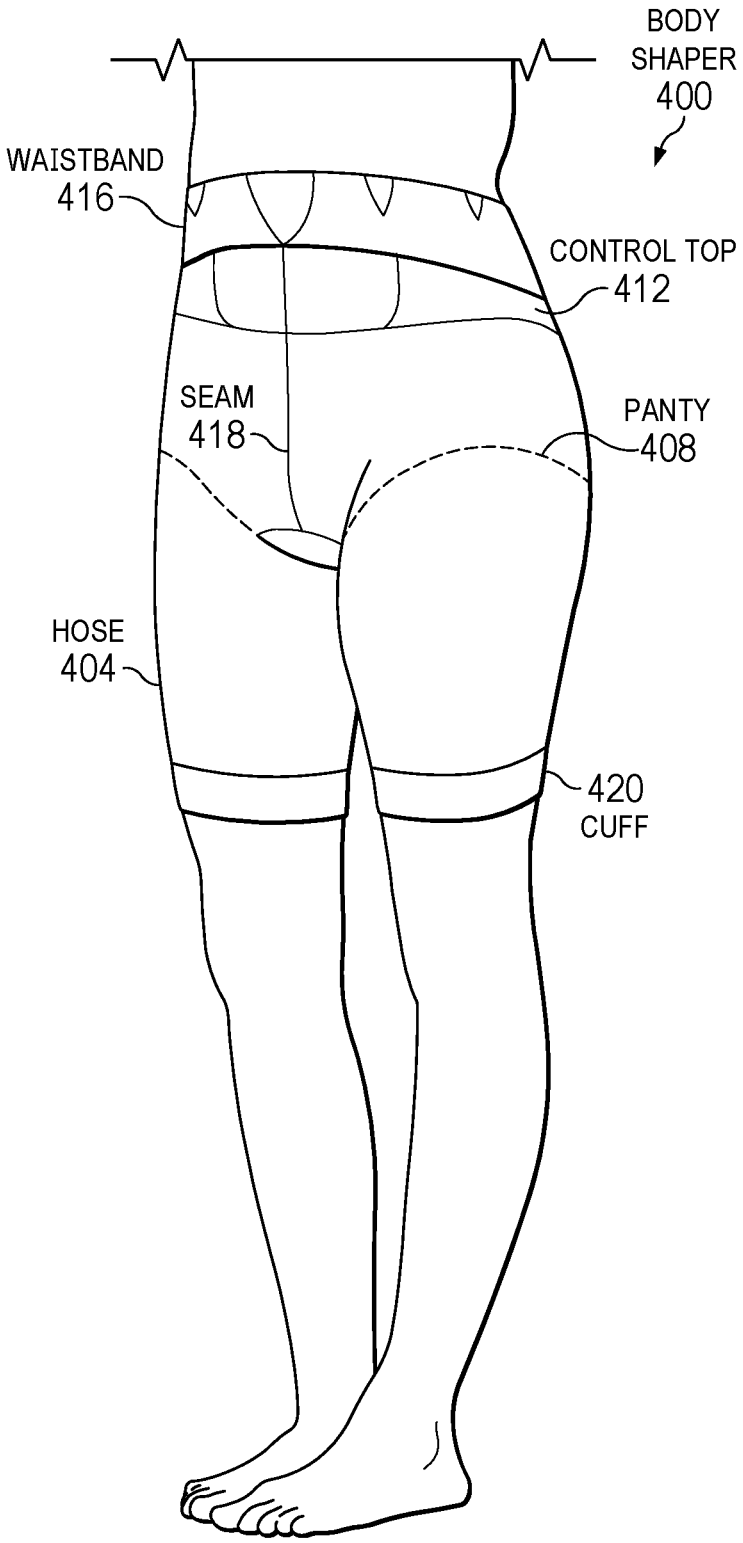
FIG. 4 is a perspective view of a body shaper having a gusseted waistband.

FIG. 4 is an illustration of yet another embodiment of a pantyhose garment, in this case body shaper 400. Body shaper 400 is distinct from pantyhose 100 and leggings 300 in that hose 404 are generally not intended to be visible. In an illustrative application, body shaper 400 may instead be worn primarily for its control features, and it may not be intended for any portion of body shaper 400 to be show under a wearer's pants or skirt. Body shaper 400 may be worn to help shape and form the wearer's thighs, hips, and waist, to smooth panty lines, and to otherwise enhance appearance and attractiveness.

Body shaper 400 includes hose 404, panty 408, control top 412, and waistband 416. Similar to leggings, 300, body shaper 400 terminates in a cuff 420. Because cuff 420 may not be intended to be visible, it is more likely to be a non-decorative cuff. Similarly, while hose 404 could be of any denier, body shapers 400 generally have higher-denier and higher-elasticity hose. In fact, hose 404, panty 408, and control top 412 may all be constructed of a high-elasticity control top blend, such as a blend having an elastane content of 15%-35%. As in previous embodiments, waistband 416 helps to secure body shaper 402 the wearer's waist. However, as in other embodiments, waistband 416 may be uncomfortable, or may pinch or bind. Thus, waistband 416 may also be provided with strain relief gussets as illustrated. Furthermore, control top 412 may be provided with front and/or rear panels as in previous embodiments.

Figure 5:
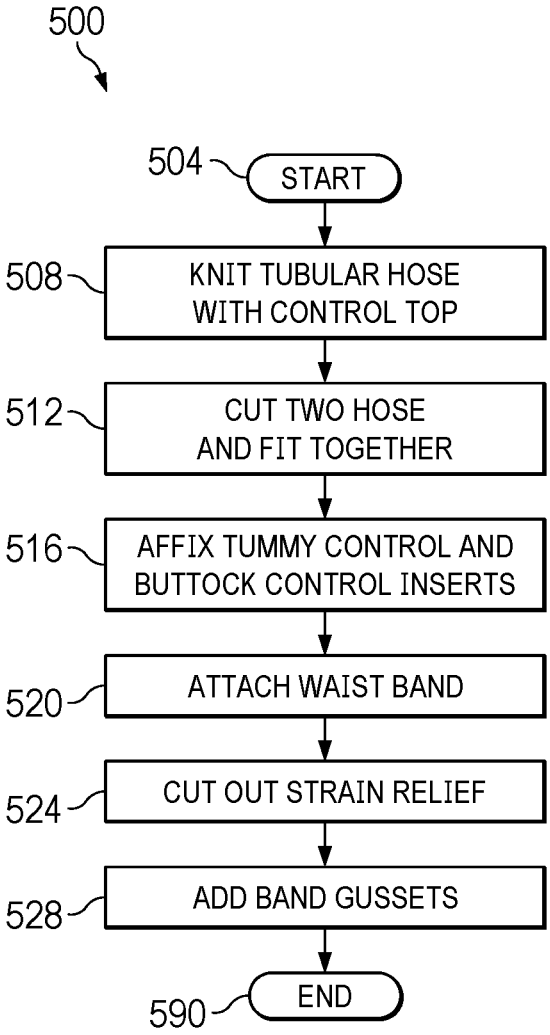
FIG. 5 is a flow chart of a method of manufacturing pantyhose with a gusseted waistband.

FIG. 5 is a flowchart of an illustrative method of manufacturing pantyhose.

FIG. 5 contemplates a knitting-based construction method, which is the most common method for manufacturing pantyhose. However, it is understood that pantyhose as described throughout the specification could also be made of other fabrics, such as a woven fabric. Furthermore, the operations illustrated in FIG. 500 are provided by way of illustrative example, and in various embodiments, the steps performed may be in a different order, some steps may be omitted, and other steps may be inserted.

The method starts at block 504. At block 508, construction of the pantyhose is begun by knitting two individual hose or stockings, which may include knitting up to the panty portion and/or a control top. This process may include using more than one gauge of needle, more than one count of needles, and/or using more than one fabric blend to form various portions of the pantyhose, such as one or more sheer, reinforced, or control portions. Optionally, the individual stockings may be provided with additional conditioning or treatment, such as board shaping or steaming. The toes, which are open from the tubular knitting process, may also be sewed at a seam, and excess material cut away, either before or after the stockings are joined.

At block 512, the two individual stockings are sliced at an upper portion (as at the welt), and then fitted together, such as by using a U-shaped stitch to sew the two stockings together. Note that this contemplates a seamed construction method. In a seamless construction method, the stockings and the panty may be knitted in a single process. Furthermore, in some cases, left and right stockings are shaped slightly differently. Once the two stockings are knitted together, they may also be dyed to a desired color, and/or further shaped or treated.

Once the pantyhose have been manufactured, treated, shaped, and/or dyed, tummy control and buttocks control inserts may be sewn into front and rear control top portions of the pantyhose.

In block 520, the waistband may be attached to the top of the panty, such as by separately manufacturing the waistband, and then sewing the waistband to the top of the panty. Note that in some embodiments, the waistband may be knitted in a unitary process with the two stockings. In that case, the waistband may have a front and rear seam. However, in cases where strain relief gussets are provided, the front and rear seams may cut out as part of the gusset process.

In block 524, strain relief may be cut out, such as by cutting a plurality of gaps of the correct shape and size in the waistband. This can include cutting out two or more strain relief regions, which may have triangular, rectangular, or oval shapes as according to the particular embodiment.

In block 528, the waistband gussets are sewn into the cut-out portions of the waistband. The waistband gussets may be made of a different material from the waistband, and may generally have lower elasticity, or may be less stiff, to help relieve strain and to prevent pinching and binding.

In block 590, the method is done.

The teachings of this specification may be combined with other improvements in pantyhose design, such as those disclosed in U.S. Pat. No. 8,661,568 and U.S. Patent Publication 2018/8036483, which are incorporated herein by reference.

Figure 6:
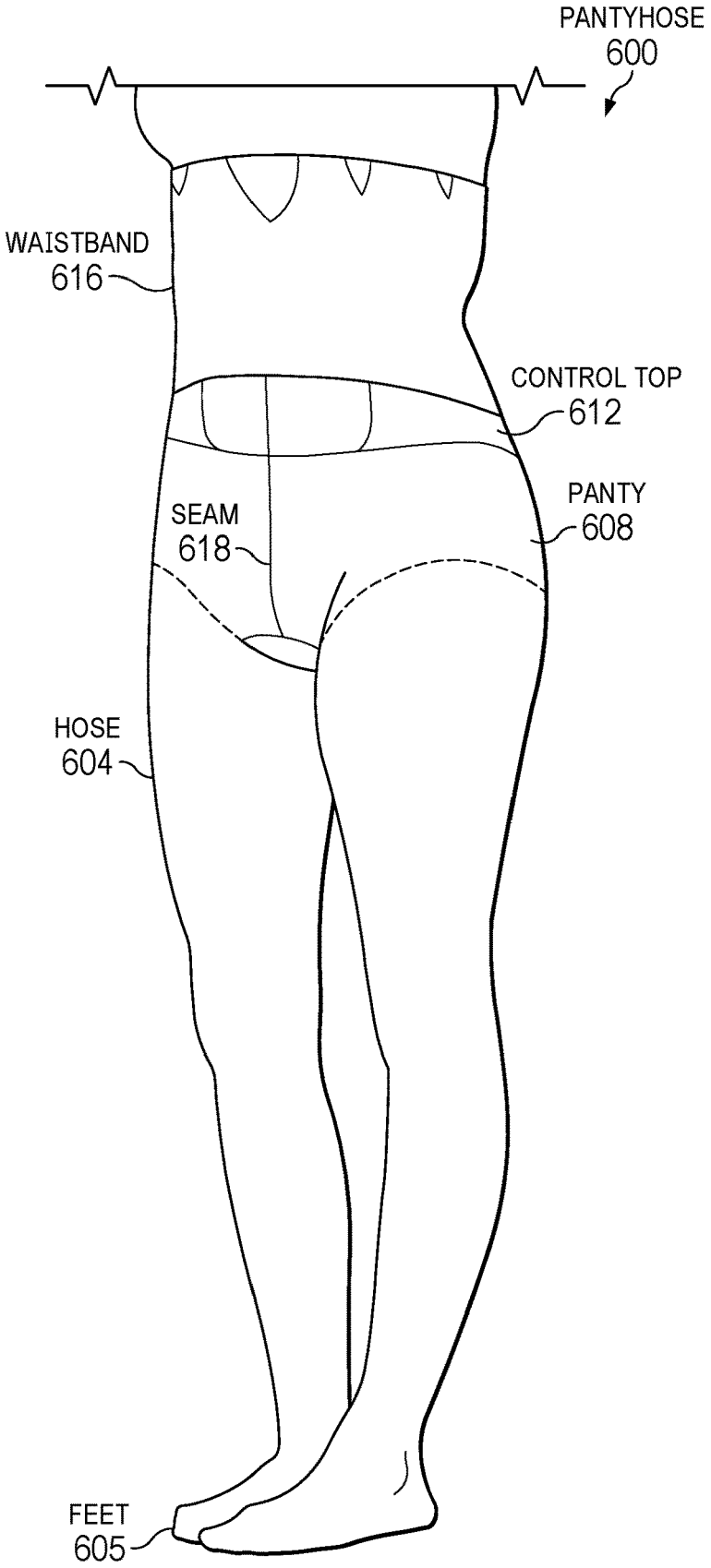
FIG. 6 is a perspective view of pantyhose with gusseted waistband, showing a high waistband

FIG. 6 is a perspective view of pantyhose with gusseted waistband, showing a high waistband. Pantyhose 600 are in various respects similar to pantyhose 100 of FIG. 1. Specifically, pantyhose 600 include hose 604, feet 605, panty 608 with seam 618, control top 612, and waistband 616. The description of corresponding elements in FIG. 1 may be considered applicable to the elements disclosed in FIG. 6. However, waistband 616 is different from waistband 116 of FIG. 1 in that waistband 616 is an extended waist band. Waist band 616 may provide additional contour and control of the waist, stomach, and chest. In this example, waistband 616 is designed to terminate just below the bust of the wearer, and otherwise may have features similar to waistband 116 of FIG. 1.

The foregoing outlines features of several embodiments so that those skilled in the art may better understand various aspects of the present disclosure. The embodiments disclosed can readily be used as the basis for designing or modifying other processes and structures to carry out the teachings of the present specification. Any equivalent constructions to those disclosed do not depart from the spirit and scope of the present disclosure. Design considerations may result in substitute arrangements, design choices, device possibilities, hardware configurations, software implementations, and equipment options.

There are also provided herein certain methods, illustrated for example in flow charts and/or signal flow diagrams. The order or operations disclosed in these methods discloses one illustrative ordering that may be used in some embodiments, but this ordering is no intended to be restrictive, unless expressly stated otherwise. In other embodiments, the operations may be carried out in other logical orders. In general, one operation should be deemed to necessarily precede another only if the first operation provides a result required for the second operation to execute. Furthermore, the sequence of operations itself should be understood to be a non-limiting example. In appropriate embodiments, some operations may be omitted as unnecessary or undesirable. In the same or in different embodiments, other operations not shown may be included in the method to provide additional results.

In certain embodiments, some of the components illustrated herein may be omitted or consolidated In certain cases, it may be easier to describe one or more functionalities by disclosing only selected element. Such elements are selected to illustrate specific information to facilitate the description. The inclusion of an element in the FIGURES is not intended to imply that the element must appear in the disclosure, as claimed, and the exclusion of certain elements from the FIGURES is not intended to imply that the element is to be excluded from the disclosure as claimed. Similarly, any methods or flows illustrated herein are provided by way of illustration only. Inclusion or exclusion of operations in such methods or flows should be understood the same as inclusion or exclusion of other elements as described in this paragraph. Where operations are illustrated in a particular order, the order is a nonlimiting example only. Unless expressly specified, the order of operations may be altered to suit a particular embodiment.

Other changes, substitutions, variations, alterations, and modifications will be apparent to those skilled in the art. All such changes, substitutions, variations, alterations, and modifications fall within the scope of this specification.

In order to aid the United States Patent and Trademark Office (USPTO) and, any readers of any patent or publication flowing from this specification, the Applicant: (a) does not intend any of the appended claims to invoke paragraph (f) of 35 U.S.C. section 112, or its equivalent, as it exists on the date of the filing hereof unless the words "means for" or "steps for" are specifically used in the particular claims; and (b) does not intend, by any statement in the specification, to limit this disclosure in any way that is not otherwise expressly reflected in the appended claims, as originally presented or as amended.

What is claimed is:

1. A hosiery garment, comprising:

knitted or woven stockings disposed to fully or partially cover a wearer's legs, the stockings having a denier value of less than 100;

a panty having a control top, and affixed to an upper end of the stockings and disposed to cover the wearer's thighs and hips, the control top comprising at least one compressive tummy control panel; and a waistband affixed to an upper end of the panty, the waistband constructed of a nylon-hybrid stretch fabric, having a height of at least two inches, and having a plurality of strain relief gussets, comprising at least a plurality of front gussets and a plurality of rear gussets, wherein the plurality of front gussets include a front center gusset, wherein the front center strain relief gusset has a height that is substantially equal to the height of the waistband, and wherein at least one of the other strain relief gussets has a height that is substantially one-half of the height of the front center strain relief gusset, and wherein the strain relief gussets are constructed of substantially 100% nylon.

2. The hosiery garment of claim 1, wherein the height of the waistband is between approximately two inches and six inches.

3. The hosiery garment of claim 1, wherein the waistband is disposed to extend from approximately the wearer's hips to approximately the wearer's bust.

4. The hosiery garment of claim 1, wherein the plurality of strain relief gussets have a substantially triangular shape.

5. The hosiery garment of claim 1, wherein the plurality of strain relief gussets include left and right hip gussets.

6. The hosiery garment of claim 1, wherein the plurality of strain relief gussets include at least eight gussets spaced substantially equidistantly around a perimeter of the waistband.

7. The hosiery garment of claim 1, wherein the control top is constructed of a nylon-elastane blend, with an elastane content of at least approximately 15%, and wherein the control top tapers from a central height of at least approximately 3 inches to a side height of approximately one inch.

8. The hosiery garment of claim 1, wherein the panty is a full control top panty.

9. The hosiery garment of claim 1, wherein the at least one compressive tummy control panel comprises antimicrobial treatment.

10. The hosiery garment of claim 9, wherein the antimicrobial treatment comprises metallic fibers.

11. The hosiery garment of claim 1, further comprising a compressive buttocks control panel.

12. The hosiery garment of claim 1, wherein the waistband is constructed of a blend of approximately 72% nylon and approximately 28% elastane.

13. The hosiery garment of claim 1, wherein the garment is footed tights or pantyhose or unfooted leggings.

14. Ladies' pantyhose, comprising:

right and left stockings of knitted or woven fibers, the right and left stockings having a denier value of less than 100 and together terminating in a panty, the panty having a control top that includes an inserted tummy control panel and an inserted buttocks control panel; and a waistband sewn to an upper end of the panty and having disposed therein a plurality of strain relief gussets, including at least a front center strain relief gusset, at least one rear gusset, and of at least two additional gussets;

wherein the front center strain relief gusset is the largest of the plurality of strain relief gussets, and wherein at least one of the additional gussets has a height that is substantially one-half height of a height of the front center strain relief gusset, and wherein the panty is constructed of a nylon-hybrid fabric and the strain relief gussets are constructed of substantially 100% nylon.

15. The ladies' pantyhose of claim 14, wherein the plurality of strain relief gussets have a substantially triangular shape.

16. Ladies' tights, comprising two legs and a panty, the panty constructed of a stretch fabric and comprising a waist band with a height of at least two inches, the waist band having disposed therein a plurality of strain relief gussets of a substantially triangular shape, and constructed of substantially 100% nylon, wherein a point of the triangular shape is disposed toward the legs of the tights, and a base of the triangular shape is disposed away from the legs of the tights, and wherein the plurality of strain relief gussets comprise at least a front center strain relief gusset and a plurality of rear strain relief gussets, wherein the front center strain relief gusset is the largest of the strain relief gussets, having a height substantially equal to the height of the waist band, and wherein at least one of the other strain relief gussets has a height that is substantially one-half of a height of the front center strain relief gusset.

17. The ladies' tights of claim 16, wherein the tights are sheer, semi-sheer, or opaque.

* * * * *